United States Patent [19]

Kuzel et al.

[11] 4,405,483

[45] Sep. 20, 1983

[54] STABLE LIQUID DETERGENTS CONTAINING ALUMINOSILICATE ION EXCHANGE MATERIAL

[75] Inventors: Maryann Kuzel; John W. Leikhim, both of Cincinnati, Ohio

[73] Assignee: The Procter & Gamble Company, Cincinnati, Ohio

[21] Appl. No.: 372,349

[22] Filed: Apr. 27, 1982

[51] Int. Cl.[3] ..... C11D 1/72; C11D 3/12; C11D 11/00; C11D 17/08

[52] U.S. Cl. ..... 252/140; 252/145; 252/155; 252/173; 252/174.21; 252/174.22; 252/174.25; 252/179; 252/528; 252/547; 252/DIG. 14

[58] Field of Search ..... 252/131, 140, 155, 145, 252/173, 174.25, 179, 528, 547

[56] References Cited

U.S. PATENT DOCUMENTS

| | | | |
|---|---|---|---|
| 4,072,622 | 2/1978 | Kühling et al. | 252/179 |
| 4,083,793 | 4/1978 | Jakobi | 252/99 |
| 4,179,393 | 12/1979 | Andree et al. | 252/155 |
| 4,247,424 | 1/1981 | Kuzel et al. | 252/528 |
| 4,265,777 | 5/1981 | Boyer et al. | 252/113 |
| 4,267,068 | 5/1981 | Diessel et al. | 252/179 |
| 4,276,205 | 6/1981 | Ferry | 252/528 |
| 4,280,920 | 7/1981 | Garvey et al. | 252/173 |
| 4,284,532 | 8/1981 | Leikhim et al. | 252/528 |
| 4,284,533 | 8/1981 | Imamura | 252/542 |

FOREIGN PATENT DOCUMENTS

| | | | |
|---|---|---|---|
| 335033 | 2/1977 | Austria | 252/140 |
| 335035 | 2/1977 | Austria | 252/140 |
| 335590 | 3/1977 | Austria | 252/140 |
| 1470250 | 4/1977 | United Kingdom | 252/140 |

OTHER PUBLICATIONS

Breck, Zeolite Molecular Sieves, 1974, pp. 502–504.

*Primary Examiner*—Dennis L. Albrecht
*Attorney, Agent, or Firm*—Donald E. Hasse; Edmund F. Gebhardt; Robert B. Aylor

[57] ABSTRACT

Stable liquid detergent compositions containing a surfactant, an aluminosilicate ion exchange material, a water-soluble detergency builder, and a stabilizing agent are prepared by dispersing the aluminosilicate material in an aqueous solution having a pH less than 7, preferably from about 4 to about 5, to partially gelatinize the aluminosilicate material, and mixing the dispersion with the balance of the ingredients to provide a stable composition having a pH greater than 7.

13 Claims, No Drawings

STABLE LIQUID DETERGENTS CONTAINING ALUMINOSILICATE ION EXCHANGE MATERIAL

TECHNICAL FIELD

The present invention relates to stable liquid detergent compositions containing a detergent surfactant, a suspended aluminosilicate ion exchange material, a water-soluble detergency builder and a stabilizing agent. The compositions herein are prepared by dispersing the aluminosilicate material in an aqueous solution having a pH less than 7 to partially gelatinize the aluminosilicate material, and mixing the dispersion with the balance of the detergent ingredients to provide a stable composition having a pH greater than 7.

There has been considerable demand for liquid detergent compositions capable of providing superior detergency under a wide variety of laundering conditions. Such compositions generally require a number of detergent ingredients which tend to separate into discrete phases. The formulation of stable liquid detergents containing insoluble aluminosilicate material is especially difficult since it tends to precipitate from suspension.

BACKGROUND ART

Breck, Zeolite Molecular Sieves, 1974, p. 502–504, discloses that aluminosilicates with a silicon/aluminum ratio of 1.5 or less gelatinize on acid treatment while those with a silicon/aluminum ratio of greater than 1.5 generally decompose and form a precipitate of hydrous silica. Zeolite A is said to be readily decomposed by HCl to form a clear gel.

Austrian Pat. No. 335,033, published Feb. 25, 1977, discloses liquid detergent compositions containing dispersed crystalline aluminosilicate material and a surfactant. It is recommended that optional builder materials be added as free acids to lower the pH to desired ranges.

Austrian Pat. No. 335,590, published Mar. 25, 1977, discloses liquid detergents containing dispersed amorphous aluminosilicates and at least two surfactants. Optional builder materials are preferably added as free acids to lower the pH.

Austrian Pat. No. 335,035, published Feb. 25, 1977, discloses liquid suspensions containing aluminosilicate material and a $C_{16-18}E_{1-8}$ nonionic surfactant. The object of the invention is to stabilize the suspension pending additional processing.

U.S. Pat. No. 4,072,622, Kühling et al., issued Feb. 7, 1978, discloses the addition of various dispersing agents, including acids, to stabilize aluminosilicate suspensions. In a preferred process, an acid is added to the aluminosilicate suspension to neutralize excess sodium hydroxide and provide a pH of from 7 to 12 prior to adding the dispersing agent.

U.S. Pat. No. 4,247,424, Kuzel et al., issued Jan. 27, 1981 and U.S. Pat. No. 4,284,532, Leikhim et al., issued Aug., 18, 1981, disclose stable liquid detergents containing mixtures of ethoxylated nonionic and amine oxide surfactants, water-soluble detergency builders and stabilizing agents.

SUMMARY OF THE INVENTION

The present invention encompasses stable liquid detergent compositions comprising:

(a) from about 5% to about 40% by weight of a detergent surfactant;

(b) from about 3% to about 30% of a finely divided aluminosilicate ion exchange material selected from the group consisting of:

(i) crystalline aluminosilicate material of the formula $$Na_z[(AlO_2)_z.(SiO_2)_y].xH_2O$$

wherein z and y are at least 6, the molar ratio of z to y is from about 1.0 to about 0.5 and x is from about 10 to about 264, said material having a particle size diameter of from about 0.1 micron to about 10 microns, a calcium ion exchange capacity of at least about 200 mg $CaCO_3$ eq./g and a calcium ion exchange rate of at least about 2 grains $Ca^{++}$/gallon/minute/gram/gallon;

(ii) amorphous hydrated aluminosilicate material of the empirical formula $M_z(zAlO_2.ySiO_2)$ wherein M is sodium, potassium, ammonium, or substituted ammonium, z is from about 0.5 to about 2, y is 1 and said material has a magnesium ion exchange capacity of at least about 50 milligrams equivalents of $CaCO_3$ hardness per gram of anhydrous aluminosilicate and a $Mg^{++}$ exchange rate of at least about 1 grain/gallon/minute/gram/gallon; and (iii) mixtures thereof;

(c) from about 1% to about 30% by weight of a water-soluble detergency builder capable of sequestering calcium and magnesium ions in water solution, selected from the group consisting of water-soluble polycarboxylates, polyphosphonates, polyphosphates, and mixtures thereof;

(d) from about 3% to about 25% by weight of a stabilizing agent selected from the group consisting of hydrophilic surface active agents having an HLB value greater than about 14 and hydrophobic emulsifiers having an HLB value less than about 8.5; and (e) from about 30% to about 88% water; said composition containing less than about 60% by weight of the detergent surfactant, aluminosilicate material and water-soluble detergency builder and prepared by dispersing the aluminosilicate material in an aqueous solution having a pH less than 7 to partially gelatinize the aluminosilicate material, and mixing the dispersion with the balance of the detergent ingredients to provide a stable composition having a pH greater than 7.

DETAILED DESCRIPTION OF THE INVENTION

The liquid detergent compositions herein comprise a detergent surfactant, an aluminosilicate ion exchange material, a water-soluble detergency builder, a stabilizing agent and water. The compositions are prepared by dispersing the aluminosilicate material in an aqueous solution having a pH less than 7 to partially gelatinize the aluminosilicate material, and mixing the dispersion with the balance of the detergent ingredients to provide a stable composition having a pH greater than 7. As used herein, stable means that there is no significant precipitation of the aluminosilicate material or separation of the composition into discrete phases. The compositions should contain less than about 60%, preferably less than about 50%, by weight of the detergent surfactants, aluminosilicate material, and water-soluble detergency builders herein for acceptable stability under a wide variety of storage conditions.

In the preparation of the present compositions, the aluminosilicate material must be partially gelatinized by being dispersed in an aqueous solution having a pH less than 7. The dispersion can conveniently be obtained by adding an aqueous slurry of the aluminosilicate material to a solution of water and acid under high shear mixing. While not intending to be limited by theory, it is believed that the stability of the present compositions is due to a portion of the aluminosilicate material decomposing under the acidic conditions to form a silica gel which gives the compositions a yield value sufficient to support the aluminosilicate material and other detergent ingredients in the form of a stable suspension. However, since the silica gel does not contribute to detergency performance, the decomposition of the aluminosilicate material should be controlled and preferably is limited to less than about 1.5% by weight. This can be accomplished by dispersing the aluminosilicate material in solutions having a pH of from about 3 to about 6.5, more preferably from about 4 to about 5, until the gel forms. As the aluminosilicate material decomposes, the pH of the dispersion will increase and slow or stop the decomposition process while neutralizing the acids. It is believed that low concentrations of the weak salts formed can alter the rheology of the dispersion and further enhance the stability of the present compositions. In a particularly preferred embodiment, weak acids such as citric acid, nitrilotriacetic acid or pyrophosphoric acid, which after neutralization also function as preferred water-soluble detergency builder herein, are used to partially decompose the aluminosilicate material.

Once formed, the aqueous dispersion comprising the aluminosilicate material is mixed with the balance of the detergent ingredients, which typically is in the form of an alkaline surfactant paste, to provide a stable composition having a pH greater than 7. The final composition pH must be greater than 7 to quench the acid-/aluminosilicate reaction and set the gel structure. The composition is preferably high sheared after mixing to assure uniformity and stability. The composition obtained is believed to be a fine emulsion containing dispersed or suspended aluminosilicate material. The stabilizing agents and preferred low molecular weight alcohols herein control final emulsion particle size and thereby contribute to product stability and yield value.

DETERGENT SURFACTANT

The compositions of the present invention contain from about 5% to about 40%, preferably from about 8% to about 25%, by weight of a detergent surfactant. The surfactant can be any anionic, cationic, nonionic, ampholytic or zwitterionic surfactant, or mixtures thereof, suitable for use in detergent compositions, such as those described in U.S. Pat. No. 3,929,678, Laughlin et al., issued Dec. 30, 1975, incorporated herein by reference.

Preferred nonionic surfactants for use herein are ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, n is from about 3 to about 9, and said nonionic surfactant has an HLB (hydrophilelipophile balance) value of from about 10 to about 13. These surfactants are more fully described in U.S. Pat. No. 4,284,532, Leikhim et al., issued Aug. 18, 1981, incorporated herein by reference. Particularly preferred are ethoxylated alcohols having an average of from about 10 to about 15 carbon atoms in the alcohol and an average degree of ethoxylation of from about 3 to about 8 moles of ethylene oxide per mole of alcohol.

Highly preferred nonionic surfactants for use herein are amine oxides of the formula

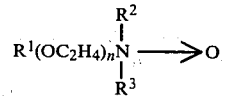

wherein $R^1$ is an alkyl, hydroxyalkyl, alkoxyhydroxypropyl, alkoxyhydroxyethyl, alkyl amido or alkyl carboxylate radical in which the alkyl and alkoxy portions contain from about 8 to about 18 carbon atoms, $R^2$ and $R^3$ are selected from the group consisting of methyl, ethyl, propyl, isopropyl, 2-hydroxyethyl, 2-hydroxypropyl, 3-hydroxypropyl and said groups joined together to form a cyclic structure in which the nitrogen is part of a heterocyclic ring, and n is from 0 to about 10, or mixtures thereof.

Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis(2-hydroxyethyl)-3-dodecoxy-2-hydroxypropylamine oxide, (2-hydroxypropyl)methyltetradecylamine oxide, dimethyloleylamine oxide, dimethyl-(2-hydroxydodecyl)amine oxide, $C_8$–$C_{20}$ alkyl alpha-dimethylamine oxide carboxylates, and the corresponding decyl, hexadecyl and octadecyl homologs of the above compounds. A particularly preferred material is dimethyl $C_{12-16}$ alkyl amine oxide.

Preferred mixtures of amine oxide and ethoxylated nonionic surfactants are described in the above U.S. Pat. No. 4,284,532, Leikhim et al.

Fatty acid amide surfactants such as ammonia amides, monoethanol amides, diethanol amides and ethoxylated amides and also useful nonionic surfactants herein. Preferred amides are $C_{8-20}$ monoethanol amides, $C_{8-20}$ diethanol amides and amides having the formula

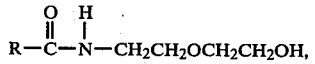

wherein R is a $C_{8-20}$ alkyl group and mixtures thereof. Particularly preferred amides are those where the alkyl group contains from about 10 to about 16 carbon atoms, such as coconut alkyl monoethanol or diethanol amide. Such compounds are commercially available under the tradenames Super-Amide L-9 and GR, from Onyx Chemical Company, Jersey City, N.J.; Super-Amide F-3 from Ryco, Inc., Conshohocken, Pa. and Gafamide CDD-518, available from GAF Corp., New York, N.Y.

Anionic surfactants useful herein include the water-soluble salts, particularly the alkali metal, alkaline earth metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium, potassium, magnesium, and mono-, di-, and triethanolammonium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants are the water-soluble salts of: alkyl glyceryl ether sulfonates, especially those ethers of higher alcohols derived from tallow and coconut oil; coconut oil fatty acid monoglyceride sulfonates and sulfates; alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Water-soluble salts of the higher fatty acids, i.e., "soaps", also are useful anionic surfactants herein. Soaps can be made by direct saponification of fats and oils or by the neutralization of free fatty acids. Examples of soaps are the sodium, potassium, ammonium, and alkylolammonium salts of higher fatty acids containing from about 8 to about 24 carbon atoms, and preferably from about 12 to about 18 carbon atoms. Particularly useful are the sodium and potassium salts of the mixtures of fatty acids derived from coconut oil and tallow, i.e., sodium or potassium tallow and coconut soaps.

Preferred anionic surfactants for use in combination with the preferred amine oxide surfactants herein are the water soluble salts of $C_{12-18}$ alkyl sulfates, $C_{12-18}$ alkyl polyethoxy sulfates containing from about 1 to about 4 moles of ethylene oxide, and mixtures thereof.

ALUMINOSILICATE ION EXCHANGE MATERIAL

The compositions herein also contain from about 3% to about 30%, preferably from about 5% to about 20%, of a finely divided aluminosilicate ion exchange material.

Crystalline aluminosilicate ion exchange materials useful in the practice of this invention have the formula $$Na_z[(AlO_2)_z \cdot (SiO_2)_y].xH_2O$$

wherein z and y are at least about 6, the molar ratio of z to y is from about 1.0 to about 0.5 and x is from about 10 to about 264. Amorphous hydrated aluminosilicate material useful herein has the empirical formula $$M_z(zAlO_2 \cdot ySiO_2)$$

wherein M is sodium, potassium, ammonium, or substituted ammonium, z is from about 0.5 to about 2, y is 1 and said material has a magnesium ion exchange capacity of at least about 50 milligram equivalents of $CaCO_3$ hardness per gram of anhydrous aluminosilicate.

The aluminosilicate ion exchange materials herein are in hydrated form and contain from about 10% to about 28% of water by weight if crystalline, and potentially even higher amounts of water if amorphous. Highly preferred crystalline aluminosilicate ion exchange materials contain from about 18% to about 22% in water in their crystal matrix. The crystalline aluminosilicate ion exchange materials are further characterized by a particle size diameter of from about 0.1 micron to about 10 microns. Amorphous materials are often smaller, e.g., from about 0.01 micron to about 10 microns. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 to 6 grains/gallons/minute/gram/gallon, based on calcium ion hardness. Optimum aluminosilicate for builder purposes exhibit a calcium ion exchange rate of at least about 4 grains/gallons/minute/gram/gallon.

The amorphous aluminosilicate ion exchange materials usually have a $Mg^{++}$ exchange capacity of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available, and can be naturally occurring or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $Na_{12}[(AlO_2)_{12}(SiO_2)_{12}].xH_2O$, wherein x is from about 20 to about 30, especially about 27.

WATER-SOLUBLE DETERGENCY BUILDER

The liquid detergent herein contain from about 1% to about 30%, preferably from about 3% to about 15%, by weight of a water-soluble detergency builder capable of sequestering calcium and magnesium ions in water solution, selected from the group consisting of water-soluble polycarboxylates, polyphosphonates, polyphosphates, and mixtures thereof.

Suitable polycarboxylate builders herein include the various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates.

Examples of such polycarboxylate builders are sodium and potassium ethylenediaminetetraacetate; sodium and potassium nitrilotriacetate; the water-soluble salts of phytic acid, e.g., sodium and potassium phytates, disclosed in U.S. Pat. No. 2,739,942, Eckey, issued Mar. 27, 1956, incorporated herein by reference; the polycarboxylate materials described in U.S. Pat. No. 3,364,103, incorporated herein by reference; and the water-soluble salts of polycarboxylate polymers and copolymers described in U.S. Pat. No. 3,308,067, Diehl, issued Mar. 7, 1967, incorporated herein by reference.

Useful detergent builders include the water-soluble salts of polymeric aliphatic polycarboxylic acids having the following structural relationships and physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

It is to be understood that while the alkali metal, and particularly the sodium and potassium, salts of the foregoing inorganic and organic detergency builder salts are preferred for use herein from economic and solubility standpoints, the ammonium, alkanolammonium, e.g., triethanolammonium, diethanolammonium, and the like, water-soluble salts of any of the foregoing builder anions are also useful herein.

Other polycarboxylates for use herein are the polyacetal carboxylates described in U.S. Pat. No. 4,144,226, issued Mar. 13, 1979 to Crutchfield et al., and U.S. Pat. No. 4,146,495, issued Mar. 27, 1979 to Crutchfield et al., incorporated herein by reference.

Preferred polycarboxylate builders for use in the present invention are sodium and potassium nitrilotriacetate, sodium and potassium citrate, and mixtures thereof.

Polyphosphonate builders useful herein are disclosed in U.S. Pat. No. 3,213,030, Diehl, issued Oct. 19, 1965, U.S. Pat. No. 3,433,021, Roy, issued Jan. 14, 1968, U.S. Pat. No. 3,292,121, Gedge, issued Jan. 9, 1969 and U.S. Pat. No. 2,599,807, Bersworth, issued June 10, 1952, all incorporated herein by reference. Preferred polyphosphonate builders are the sodium and potassium salts of ethylene diphosphonic acid, ethane 1-hydroxy-1, 1-diphosphonic acid, and ethane-1,1,2-triphosphonic acid.

Preferred aminopolyphosphonate builders are the sodium and potassium salts of diethylenetriaminepentamethylenephosphonic acid, hexamethylenediaminetetramethylenephosphonic acid, diethylenediaminetetramethylenephosphonic acid, and nitrilotrimethylenephosphonic acid.

Polyphosphates useful herein include the water-soluble tripolyphosphates, pyrophosphates, and the polymeric metaphosphates having a degree of polymerization of from about 6 to 21. However, the tripolyphosphates and metaphosphates tend to hydrolyze to a mixture of orthophosphate and pyrophosphate with prolonged storage in aqueous solutions. Since the orthophosphates precipitate but do not sequester water-hardness ions, the pyrophosphates are the preferred polyphosphates for use in the present invention. Particularly preferred is potassium pyrophosphate since sodium pyrophosphate has a tendency to precipitate from concentrated solutions at low storage temperatures.

STABILIZING AGENT

The present compositions also contain from about 3% to about 25% by weight of a stabilizing agent selected from the group consisting of hydrophilic surface active agents having an HLB value greater than about 14 and hydrophobic emulsifiers having an HLB value less than about 8.5.

Hydrophobic emulsifiers useful herein in the formulation of stable liquid detergents in emulsion form are substantially water-insoluble and generally have an HLB value below about 8.5, preferably below about 7. Particularly useful are the alkali metal, ammonium and mono-, di-, and tri-$C_{1-4}$ alkyl and alkanol ammonium salts of dialkyl sulfosuccinic acid, said alkyl groups each containing from about 5 to about 20 carbon atoms, preferably from about 8 to about 18 carbon atoms.

Other hydrophobic emulsifiers are quaternary ammonium compounds with more than one alkyl group each containing at least 8 carbon atoms, e.g., di-$C_{12-18}$ alkyl ammonium chloride, bromide, methyl sulfate, nitrate, and acetate and di-$C_{12-18}$ alkyl ammonium chloride, bromide, methyl sulfate, nitrate and acetate and di-$C_{12-18}$ alkyl imidazolinium quaternary ammonium compounds.

Additional hydrophobic emulsifiers are the alkyl or alkyl ethoxy diesters of phosphoric acid having the formula

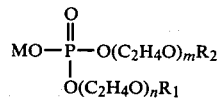

in which both $R_1$ and $R_2$ are alkyl groups containing from about 8 to about 20, preferably from about 10 to about 18, carbon atoms, n and m are from about zero to about 8 and M is hydrogen or a salt forming cation. Commercially available phosphate esters are mixtures of mono- and di-alkyl esters. Materials with a high percentage of di-esters are preferred. Lecithin, a natural phosphatidyl choline is a suitable hydrophobic emulsifier for the practice of the present invention.

Mixtures of the above hydrophobic emulsifiers or other emulsifiers can be utilized.

The level of hydrophobic emulsifier useful to maintain emulsion stability will depend on the nature and level of other ingredients, particularly the ethoxylated nonionic surfactant. A preferred emulsifier level is from about 3% to about 16% by weight of the total composition. Stable water-in-oil emulsions can be produced at ethoxylated nonionic surfactant to hydrophobic emulsifier weight ratios of from about 6:1 to about 2:1.

The components of the present compositions, other than the water-insoluble aluminosilicate ion exchange material, are preferably stabilized in an isotropic form by the use of water-soluble hydrophilic stabilizing agents with HLB values above about 14. Such isotropic liquids are not necessarily true solutions. Many of the compositions herein appear to be microemulsions of an oil phase in water, the oil phase comprising, inter alia, the bulk of the ethoxylated nonionic surfactant.

Suitable hydrophilic anionic stabilizing agents have shorter alkyl chain lengths than the corresponding surfactants used as the principal surfactant in detergent compositions. For example, the soluble salts, particularly potassium salts, of toluene sulfonate, xylene sulfonate and cumene sulfonate are useful hydrophilic stabilizing agents.

Phosphate esters, particularly those with a predominance of single alkyl groups and designated primary esters can have the hydrophilic characteristics necessary to assist in the formation of an isotropic liquid detergent composition. Useful phosphate esters will contain a high proportion of monoalkyl phosphate esters and can be of the type consisting of the condensation product of the reaction of $R(CH_2CH_2O)_xOH$ and a phosphoric or polyphosphoric acid, R being an alkyl or alkyl phenyl group, said alkyl containing from about 4 to about 18 carbon atoms and x being 0 to 20.

Ethoxylated nonionic surfactants with a relatively high degree of ethoxylation and a corresponding high HLB value can find use in the compositions of the present invention as stabilizing agents.

Mixtures of hydrophilic stabilizing agents, especially mixtures of lower alkylbenzene sulfonates, such as toluene sulfonate, and phosphate esters, are useful.

The types and levels of hydrophilic stabilizing agents needed to produce an isotropic liquid detergent composition will be dependent on the type and level of other components, particularly the ethoxylated nonionic surfactant and its extent of water solubility. A preferred level of hydrophilic stabilizing agents to form isotropic microemulsions is from about 5% to about 15% by weight of the liquid detergent composition.

WATER

The compositions of the present invention contain from about 30% to about 88%, preferably from about 40% to about 65%, by weight of water.

OPTIONAL COMPONENTS

The compositions of the present invention can also contain minor amounts of a suds modifying agent, such as the fatty amide surfactants, silicone materials, microcrystalline waxes and phosphate esters described in U.S. Pat. No. 4,284,532, Leikhim et al., issued Aug. 18, 1981, particularly from Column 7, line 25 to Column 9, line 8, incorporated herein by reference. The fatty acid soap and ester mixtures described in U.S. Pat. No. 4,017,409, Demessemaekers et al., issued Apr. 12, 1977, incorporated herein by reference, are also useful suds suppressors herein.

Low molecular weight (e.g., $C_2$–$C_4$) aliphatic monohydric alcohols, particularly ethanol, are preferably added in minor amounts (less than 4% and preferably less than about 2% by weight) to the present compositions to control product phase stability, viscosity and yield value.

Also useful in the compositions of this invention are suspending or thickening agents such as colloidal silica having a mean particle diameter ranging from about 0.01 micron to about 0.05 micron, colloidal clays such as bentonites or chemically treated bentonites, isomorphous silicates, especially those with a high magnesium content and particulate organic polymers such as those disclosed in U.S. Pat. No. 3,393,153, Zimmerer et al., issued July 16, 1968, from Column 6, line 60 to Column 7, line 24, incorporated herein by reference. Colloidal clays are especially preferred suspending and thickening agents and provide particularly stable compositions when product pH is maintained or adjusted to a range of from about 8.0 to about 10.0.

Other optional components which can be included in the compositions of the present invention include anionic and ampholytic surfactants; bleaching agents; bleach activators; soil release agents; soil suspending agents; corrosion inhibitors; dyes; fillers; optical brighteners; germicides; enzymes; enzyme-stabilizing agents; perfumes; solvents; carriers; opacifiers; pH adjusting agents; alkalinity sources; and the like. A preferred composition pH of from about 9 to about 12 can be obtained by the use of suitable alkaline materials such as sodium hydroxide, sodium or potassium carbonate or bicarbonate, sodium or potassium silicates and the alkanolamines. Particularly preferred is monoethanol amine at levels of from about 1% to about 8% by weight.

All percentages, parts, and ratios used herein are by weight unless otherwise specified.

The following nonlimiting examples illustrate compositions of the present invention.

EXAMPLE I

The compositions of this example were prepared by adding aqueous slurries of the sodium aluminosilicate Zeolite A (avg. dia. of 4 microns) to mixtures of water and citric acid (and polyethylene glycol when present) having a pH of about 4.3 (adjusted by adding sodium hydroxide) under high shear mixing. The gelled dispersions produced were then added to mixture of the remaining ingredients and blended under high shearing conditions.

| | Wt. % | | |
|---|---|---|---|
| Component | A | B | C |
| $C_{12-13}$ alcohol polyethoxylate (6.5) | 13.3 | 13.3 | — |
| $C_{9-11}$ alcohol polyethoxylate (4) | — | — | 13.3 |
| $C_{12-16}$ alkyldimethylamine oxide | 6.7 | 6.7 | 6.7 |
| Monoethanolamine | 3.0 | 3.0 | 3.0 |
| Sodium Zeolite A | 12.0 | 12.6 | 12.6 |
| Potassium pyrophosphate | — | 5.0 | 5.0 |
| Sodium xylene sulfonate | 3.0 | 3.5 | 4.0 |
| Ethanol | 0.5 | 1.0 | 1.5 |
| Polyethylene glycol 6000 | 0.7 | 0.7 | 0.7 |
| Sodium citrate | 5.1 | 5.1 | 5.1 |
| Sodium hydroxide | 0.5–2.0 | 0.5–2.0 | 0.5–2.0 |
| Water and minors | Balance to 100 | | |

The above compositions were stable after one month storage at about 21° C. At a usage level of ½ cup in washing machines containing about 60 l of 15° C., the compositions provided excellent cleaning relative to commercial liquid detergent products.

EXAMPLE II

The compositions of this example are prepared according to the procedure of Example I using citric acid, nitrilotriacetic acid or pyrophosphoric acid to partially gelatinize the aluminosilicate material.

| Component | Wt. % A | B | C | D |
|---|---|---|---|---|
| $C_{12-13}$ alcohol polyethoxylate (6.5) | 11.5 | 10.3 | 11.5 | 10.3 |
| $C_{12-16}$ alkyl dimethylamine oxide | 6.7 | 6.3 | 6.7 | 6.3 |
| Sodium Zeolite A (avg. dia. 2 microns) | 10.0 | 10.0 | 10.0 | 10.0 |
| Sodium citrate | 10.0 | — | — | — |
| Sodium nitrilotriacetate | — | 7.0 | — | 6.0 |
| Potassium pyrophosphate | — | — | 12.0 | 6.0 |
| Monoethanolamine | 4.0 | 4.0 | 4.0 | 4.0 |
| Potassium toluene sulfonate | 12.0 | 10.0 | 12.0 | 12.0 |
| Ethanol | 2.0 | 2.0 | 2.0 | 2.0 |
| Bentonite clay | 1.5 | — | 1.5 | 1.5 |
| Water and minors | | Balance to 100 | | |

EXAMPLE III

The compositions of this example are prepared according to the procedure of Example II with the exception that the alcohol polyethoxylate surfactants are mixed with the hydrophobic emulsifier sodium dioctyl sulfosuccinate before the remaining components are blended with the gelled dispersions. Stable emulsions with suspended sodium aluminosilicate are formed.

| Component | Wt. % A | B | C |
|---|---|---|---|
| $C_{12-13}$ alcohol polyethoxylate (6.5) | 11.5 | 11.5 | — |
| $C_{11-15}$ alcohol polyethoxylate (5) | — | — | 10.0 |
| $C_{12-16}$ alkyl dimethylamine oxide | 6.7 | 6.7 | 5.0 |
| Sodium Zeolite A (avg. dia. 3 microns) | 8.0 | 5.0 | 4.0 |
| Sodium citrate | 10.0 | — | — |
| Sodium nitrilotriacetate | — | 12.5 | 8.0 |
| Potassium pyrophosphate | — | — | 6.0 |
| Sodium dioctyl sulfosuccinate | 5.0 | 5.0 | 6.0 |
| Monoethanolamine | 3.0 | 3.0 | 3.0 |
| Ethanol | 0.5 | 0.5 | 0.5 |
| Bentonite clay | 1.5 | 1.5 | 1.5 |
| Water and minors | | Balance to 100 | |

EXAMPLE IV

Other compositions of the present invention prepared according to the procedure of Example II are as follows.

| Component | Wt. % A | B | C | D |
|---|---|---|---|---|
| Sodium $C_{14-15}$ alkyl polyethoxy (2.25) sulfate | 2.9 | 8.3 | — | — |
| $C_{12-13}$ alcohol polyethoxylate (6.5) | 6.4 | — | 6.6 | 6.6 |
| $C_{12-16}$ alkyldimethylamine oxide | 3.3 | 3.3 | 3.4 | 3.4 |
| Sodium Zeolite A (avg. dia. 1 micron) | 9.0 | 12.0 | 16.2 | 16.2 |
| Sodium oleate | 0.4 | — | 10.9 | 10.9 |
| Sodium citrate | 9.0 | — | — | — |
| Sodium nitrilotriacetate | — | 8.0 | 7.9 | — |

-continued

| Component | Wt. % A | B | C | D |
|---|---|---|---|---|
| Potassium pyrophosphate | — | — | — | 7.9 |
| Sodium carbonate | — | — | 3.7 | 3.7 |
| Potassium toluene sulfonate | 9.0 | 9.0 | 3.0 | 5.0 |
| Monoethanolamine | 2.7 | 2.3 | — | — |
| Ethanol | — | — | 2.2 | 2.2 |
| Water and minors | | Balance to 100 | | |

What is claimed is:

1. A process for preparing a stable liquid detergent composition comprising:

(a) from about 5% to about 40% by weight of a detergent surfactant;

(b) from about 3% to about 30% of a finely divided aluminosilicate ion exchange material selected from the group consisting of:

(i) crystalline aluminosilicate material of the formula $$Na_z[(AlO_2)_z.(SiO_2)_z].xH_2O$$

wherein z and y are at least 6, the molar ratio of z to y is from about 1.0 to about 0.5 and x is from about 10 to about 264, said material having a particle size diameter of from about 0.1 micron to about 10 microns, a calcium ion exchange capacity of at least about 200 mg $CaCO_3$ eq./g and a calcium ion exchange rate of at least about 2 grains $Ca^{++}$/gallon/minute/gram/gallon;

(ii) amorphous hydrated aluminosilicate material of the empirical formula $M_z(zAlO_2.ySiO_2)$ wherein M is sodium, potassium, ammonium, or substituted ammonium, z is from about 0.5 to about 2, y is 1 and said material has a magnesium ion exchange capacity of at least about 50 milligrams equivalents of $CaCO_3$ hardness per gram of anhydrous aluminosilicate and a $Mg^{++}$ exchange rate of at least about 1 grain/gallon/minute/gram/gallon; and (iii) mixtures thereof;

(c) from about 1% to about 30% by weight of a water-soluble detergency builder capable of sequestering calcium and magnesium ions in water solution, selected from the group consisting of water-soluble polycarboxylates, polyphosphonates, polyphosphates, and mixtures thereof;

(d) from about 3% to about 25% by weight of a stabilizing agent selected from the group consisting of hydrophilic surface active agents having an HLB value greater than about 14 and hydrophobic emulsifiers having an HLB value less than about 8.5; and (e) from about 30% to about 88% water; said composition containing less than about 60% by weight of the detergent surfactant, aluminosilicate material and water-soluble detergency builder; said process comprising dispersing the aluminosilicate material in an aqueous solution having a pH less than 7 to partially gelatinize the aluminosilicate material, and mixing the dispersion with the balance of the detergent ingredients to provide a stable composition having a pH greater than 7.

2. The process of claim 1 prepared by dispersing the aluminosilicate material in an aqueous solution having a pH of from about 3 to about 6.5 to partially gelatinize the aluminosilicate material.

3. The process of claim 2 prepared by dispersing the aluminosilicate material in an aqueous solution having a pH of from about 4 to about 5 to partially gelatinize the aluminosilicate material.

4. The process of claim 1 wherein the detergent surfactant comprises an amine oxide surfactant of the formula

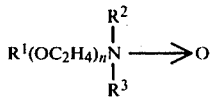

wherein $R^1$ is an alkyl, hydroxyalkyl, alkoxyhydroxypropyl, alkoxyhydroxyethyl, alkyl amido or alkyl carboxylate radical in which the alkyl and alkoxy portions contain from about 8 to about 18 carbon atoms, $R^2$ and $R^3$ are selected from the group consisting of methyl, ethyl, propyl, isopropyl, 2-hydroxyethyl, 2-hydroxypropyl, 3-hydroxypropyl, and said groups joined together to form a cyclic structure in which the nitrogen is part of a heterocyclic ring, and n is from 0 to about 10.

5. The process of claim 4 wherein in the amine oxide surfactant the $R^1$ substituent is an alkyl radical containing from about 12 to about 16 carbon atoms, $R^2$ and $R^3$ are methyl and n is 0.

6. The process of claim 4 wherein the detergent surfactant additionally comprises an ethoxylated alcohol or ethoxylated alkyl phenol nonionic surfactant of the formula $R(OC_2H_4)_nOH$, wherein R is selected from the group consisting of aliphatic hydrocarbon radicals containing from about 8 to about 15 carbon atoms and alkyl phenyl radicals in which the alkyl group contains from about 8 to about 12 carbon atoms, n is from about 3 to about 9 and said nonionic surfactant has an HLB value of from about 10 to about 13.

7. The process of claim 6 wherein the nonionic surfactant is an ethoxylated alcohol in which R is an alkyl group containing from about 10 to about 14 carbon atoms and n is from about 3 to about 8.

8. The process of claim 7 wherein in the amine oxide surfactant the $R^1$ substituent is an alkyl radical containing from about 12 to about 16 carbon atoms, $R^2$ and $R^3$ are methyl and n is 0.

9. The process of claim 4 wherein the detergent surfactant additionally comprises an anionic surfactant selected from the group consisting of water-soluble salts of $C_{12-18}$ alkyl sulfates, $C_{12-18}$ alkyl polyethoxy sulfates containing from about 1 to about 4 moles of ethylene oxide, and mixtures thereof.

10. The process of claim 9 wherein in the amine oxide surfactant the $R^1$ substituent is an alkyl radical containing from about 12 to about 16 carbon atoms, $R^2$ and $R^3$ are methyl and n is 0.

11. The process of claim 1 wherein the aluminosilicate material comprises synthetic crystalline Zeolite A.

12. The process of claim 1 wherein the water-soluble detergency builder comprises sodium or potassium nitrilotriacetate, citrate, pyrophosphate or mixtures thereof.

13. The process of claim 8 or 10 wherein the aluminosilicate material comprises synthetic crystalline Zeolite A and the water-soluble detergency builder comprises sodium or potassium nitrilotriacetate, ctirate, pyrophosphate or mixtures thereof.

* * * * *